US007464931B2

(12) United States Patent
Hammer et al.

(10) Patent No.: US 7,464,931 B2
(45) Date of Patent: Dec. 16, 2008

(54) APPARATUS FOR POSITIONING A TRAILING EDGE OF SHEETS

(75) Inventors: Christoph Hammer, Marbach (DE); Klaus Peter Schreiber, Asperg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 302 days.

(21) Appl. No.: 11/396,024

(22) Filed: Mar. 31, 2006

(65) Prior Publication Data

US 2007/0020008 A1 Jan. 25, 2007

Related U.S. Application Data

(60) Provisional application No. 60/667,103, filed on Mar. 31, 2005.

(30) Foreign Application Priority Data

Apr. 1, 2005 (DE) ..... 10 2005 015 095

(51) Int. Cl.
*B65H 7/02* (2006.01)

(52) U.S. Cl. ..... 271/264; 271/265.01

(58) Field of Classification Search ..... 271/264, 271/265.01, 265.02
See application file for complete search history.

(56) References Cited

U.S. PATENT DOCUMENTS

| | | | | |
|---|---|---|---|---|
| 6,644,660 | B2 * | 11/2003 | Sussmeier et al. | 271/270 |
| 6,687,569 | B1 * | 2/2004 | Skinger et al. | 700/220 |
| 6,687,570 | B1 * | 2/2004 | Sussmeier et al. | 700/220 |
| 6,929,260 | B1 * | 8/2005 | Koelle | 271/167 |
| 6,942,216 | B1 * | 9/2005 | Koelle | 271/270 |

FOREIGN PATENT DOCUMENTS

| | | | |
|---|---|---|---|
| DE | 32 39 799 | A1 | 5/1984 |
| DE | 84 06 391.2 | U1 | 7/1984 |
| DE | 39 31 522 | A1 | 4/1991 |
| DE | 93 04 281.7 | U1 | 6/1993 |
| DE | 299 04 757 | U1 | 7/1999 |
| EP | 0 418 456 | A1 | 3/1991 |
| GB | 286460 | | 3/1928 |
| WO | 0 618 164 | A2 | 10/1994 |
| WO | 96/25294 | | 8/1996 |

* cited by examiner

*Primary Examiner*—Kaitlin S Joerger
(74) *Attorney, Agent, or Firm*—Laurence A. Greenberg; Werner H. Stemer; Ralph E. Locher

(57) ABSTRACT

An apparatus positions sheets preferably moving in a combination folding machine and defines a trailing edge range. A trailing edge of the sheet is to be positioned in a transport direction, depending on the dimensions of the sheet. The apparatus has positioning devices, by which the trailing edge can be positioned. The positioning devices are fixed to a carrier, and also a carrier actuating device is provided, by which the carrier can be moved by a predefined actuating travel in the transport direction of the sheets, so that the trailing edge is positioned within a trailing edge positioning range. The positioning devices are fixed to the carrier such that the respectively different trailing edge positioning ranges of the individual positioning devices in total cover the entire trailing edge range but each respective trailing edge positioning range is shorter in the transport direction than the trailing edge range.

15 Claims, 9 Drawing Sheets

APPARATUS FOR POSITIONING A TRAILING EDGE OF SHEETS

CROSS-REFERENCE TO RELATED APPLICATIONS

This application claims priority, under 35 U.S.C. §119(e), of provisional application No. 60/667,103, filed Mar. 31, 2005; the application also claims priority, under 35 U.S.C. §119, of German patent application No. 10 2005 015 095.0, filed Apr. 1, 2005; the prior applications are herewith incorporated by reference in their entirety.

BACKGROUND OF THE INVENTION

Field of the Invention

The invention relates to an apparatus for positioning a trailing edge of sheet-like objects preferably moved in a combination folding machine. The apparatus has a positioning device by which the trailing edge of a sheet can be positioned, the positioning device being fixed to a carrier. A carrier actuating device is provided, by which the carrier can be moved by a predefined actuating travel in a transport direction of the sheets, so that the trailing edge of the sheet can be positioned within a trailing edge positioning range.

In combined pocket/blade folding machines, what are known as combination folding machines, the parallel folds are folded in a first folding station on the pocket folding principle, while the following cross folds are carried out with a folding blade operating vertically. For this purpose, following the parallel fold outlet, the folded sheets are transported without slippage to a cross folding station by transport belts. In order to ensure actually slippage-free transport, the transported flat goods must be held down and pressed vertically onto the transport belt. In order to produce the vertical contact force required for this, both loading balls and guide rollers are used. Loading ball systems of this type are known, for example from German Utility Model DE 84 06 391. In recent times, however, the use of guide rollers, which are described in German Utility Model DE 93 04 281, for example, has become more widespread. As compared with the loading ball system, these have particular advantages which relate, for example, in the fact that track-accurate sheet guidance can be achieved with guide rollers. In addition, the sheet can be folded without any weight loading. Furthermore, when guide rollers are used, it is possible to prevent the sheet springing back off the stops.

In order to prevent the sheet springing back off the stops, brushes or a brush strip are also placed on the folded sheet trailing edge for the purpose of the final positional fixing of the folded sheet. However, the brush strip, which brakes the folded sheet top side, is disadvantageous in particular for folded sheets having a low grammage, since symmetrical contact and therefore uniform braking are possible only with difficulty. In addition, the setting and positioning of the brushes or ball strips is time-consuming.

A precondition for the aforementioned advantages of the guide rollers is that the guide roller located closest to the cross fold stop is positioned exactly, which therefore results in that the sheet lies "free" between the leading edge stop and the guide roller. In order to ensure this, the guide roller must be positioned in such a way that the roller is just still rotating and is neither on the sheet trailing edge nor directly on the folded sheet. An apparatus of this type is known from German Utility Model specification DE 299 047 57. In this, an apparatus for holding down and loading moving sheet-like objects is proposed in which one or more guide rollers are provided in order to hold down the objects. For fully accurate positioning of the guide rollers, at least one of these guide rollers is equipped with a marking.

In the aforementioned folding machines, to some extent a plurality of blade folding units are also disposed one after another. When the sheets are aligned with leading edge and trailing edge stops in the first blade folding unit, the folding sheet is aligned longitudinally and centrally with respect to the following blade folding unit. In the event of a change in the format of the sheets, the leading stop and the trailing edge stop must also be moved in accordance with the new format. The size of the sheet upstream of the first blade folding unit depends on the size of the unfolded sheet and also on the manner in which the sheet has already been folded until it reaches the first blade folding unit. Because of the longitudinally central alignment, the actuating travel to be covered is divided uniformly between the adjustment of the leading edge stop and the trailing edge stop. For instance, the deviations of the format of the sheet upstream of the first blade folding unit are 48 cm. In the above-mentioned case, an actuating travel of up to 24 cm would therefore be necessary.

The drawback with the generic apparatus from the prior art is precisely this long actuating travel which such an apparatus has in the sheet running direction, since the actuating travel must be kept free. As a result, a sheet would not be guided over a correspondingly great distance, which can have a detrimental effect on the folding result, in particular for small sheets.

SUMMARY OF THE INVENTION

It is accordingly an object of the invention to provide an apparatus for positioning a trailing edge of sheet-like objects which overcomes the above-mentioned disadvantages of the prior art devices of this general type.

With the foregoing and other objects in view there is provided, in accordance with the invention an apparatus for positioning sheets. The apparatus has a trailing edge range, in which a trailing edge of a sheet being positioned in a transport direction, depends on dimensions of the sheet, a carrier, and a plurality of positioning devices for positioning the trailing edge of the sheet. The positioning devices are fixed to the carrier such that respectively different trailing edge positioning ranges of individual ones of the positioning devices in total cover entirely the trailing edge range but each of the respectively different trailing edge positioning ranges is shorter in the transport direction than the trailing edge range. A carrier actuating device is provided for moving the carrier by a predefined actuating travel in the transport direction of the sheets, so that the trailing edge of the sheet can be positioned within one of the respectively different trailing edge positioning ranges.

Now, from the prior art it is known that the trailing edge range, as it is known, that is to say the range over which the trailing edge of a sheet to be folded could lie on account of the format of the sheet to be processed or on account of preceding operations in order still to be able to be processed by the folding machine, must be smaller than the trailing edge positioning range. In this case, the trailing edge positioning range defines that region in which a positioning device can perform positioning. If the positioning device is fixed, then the trailing edge positioning range has no extent; if the positioning device can be adjusted along an actuating travel, then the limits of this adjustability specify the trailing edge positioning range precisely, since outside this trailing edge positioning range no trailing edge positioning by the positioning device is possible.

However, if the trailing edge region were not covered by the trailing edge positioning range, some of the sheets could not undergo positioning of the trailing edge and would therefore not strike the leading edge stop properly.

Accordingly, the invention is based on the coverage of the trailing edge range by a plurality of trailing edge positioning ranges being achieved. Since the trailing edge positioning range is not greater than the actuating travel, a shortening of the actuating travel can be achieved by this measure. As a result, there remains space in which other elements, for example hold-downs, can be accommodated, so that improved guidance of the sheets on the way to the leading edge stop can be ensured.

In an advantageous development of the apparatus according to the invention, the trailing edge position ranges of the individual positioning devices do not overlap. Therefore the trailing edge positioning ranges adjoin one another directly and without gaps in the transport direction in order to cover the trailing edge range completely. However, this does not mean that the actuating travel of the carrier likewise has the same length of the individual trailing edge position ranges of the individual positioning devices; instead, the actuating travel in the transport direction of the carrier is advantageously somewhat longer than the length of the individual trailing edge positioning ranges of the individual positioning devices. Dispensing with overlapping the trailing edge positioning ranges makes it easier to control the drive of the carrier, since each possible trailing edge position is assigned one and only one trailing edge positioning range. On the other hand, by the somewhat longer actuating travel, it is ensured with adequate certainty that every point in the respective trailing edge positioning range can also actually be selected.

In a particularly advantageous refinement of the apparatus according to the invention, the positioning devices are guide rollers that are under the action of spring forces. Guide rollers of this type also already have proven to be worthwhile in comparable applications.

In an advantageous development of this embodiment, the guide rollers are assigned a back-pressure device, for example a common belt or individual backing rollers.

In an advantageous development of the apparatus according to the invention, an activation device is assigned to the positioning devices, the activation device is configured in such a way that the positioning devices can be moved thereby into an active or passive operating position. In the passive operating position, the positioning devices are not in contact with the sheet. Typically, all those positioning devices which are located above the sheet at the folding time are in a passive operating position, in order not to hinder the folding by friction or to leave behind possible markings on the sheet. In the active operating position, the positioning devices interacts with the back-pressure device and can fulfill two functions. The first is the positioning of the trailing edge, in that the positioning devices are located precisely at the point at which the trailing edge is intended to come to lie. The second function is holding down the sheet on the way to the leading-edge stop. This function is fulfilled by all positioning devices which are disposed upstream of the positioning devices that perform the positioning of the trailing edge.

In a particularly advantageous refinement of this embodiment, the activation device is configured in such a way that the operating position of all the positioning devices can be adjusted by a common pulling device. In this case, the pulling device is, for example, a toothed belt or an adjustable actuating strip. Alternatively, however, it is also conceivable to assign each positioning device its own activation device, for example small actuating motors with appropriate control.

In a particularly advantageous refinement of this embodiment, the activation device is configured in such a way that, following the movement of the positioning devices disposed after a first positioning device in the transport direction into an active operating position, all the positioning devices disposed upstream are in an active operating position.

In a further particularly advantageous refinement of this embodiment, the activation device is configured in such a way that, following the movement of positioning devices disposed after the first positioning device in the transport direction into a passive operating position, all the positioning devices disposed downstream are in a passive operating position.

Other features which are considered as characteristic for the invention are set forth in the appended claims.

Although the invention is illustrated and described herein as embodied in an apparatus for positioning a trailing edge of sheet-like objects, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
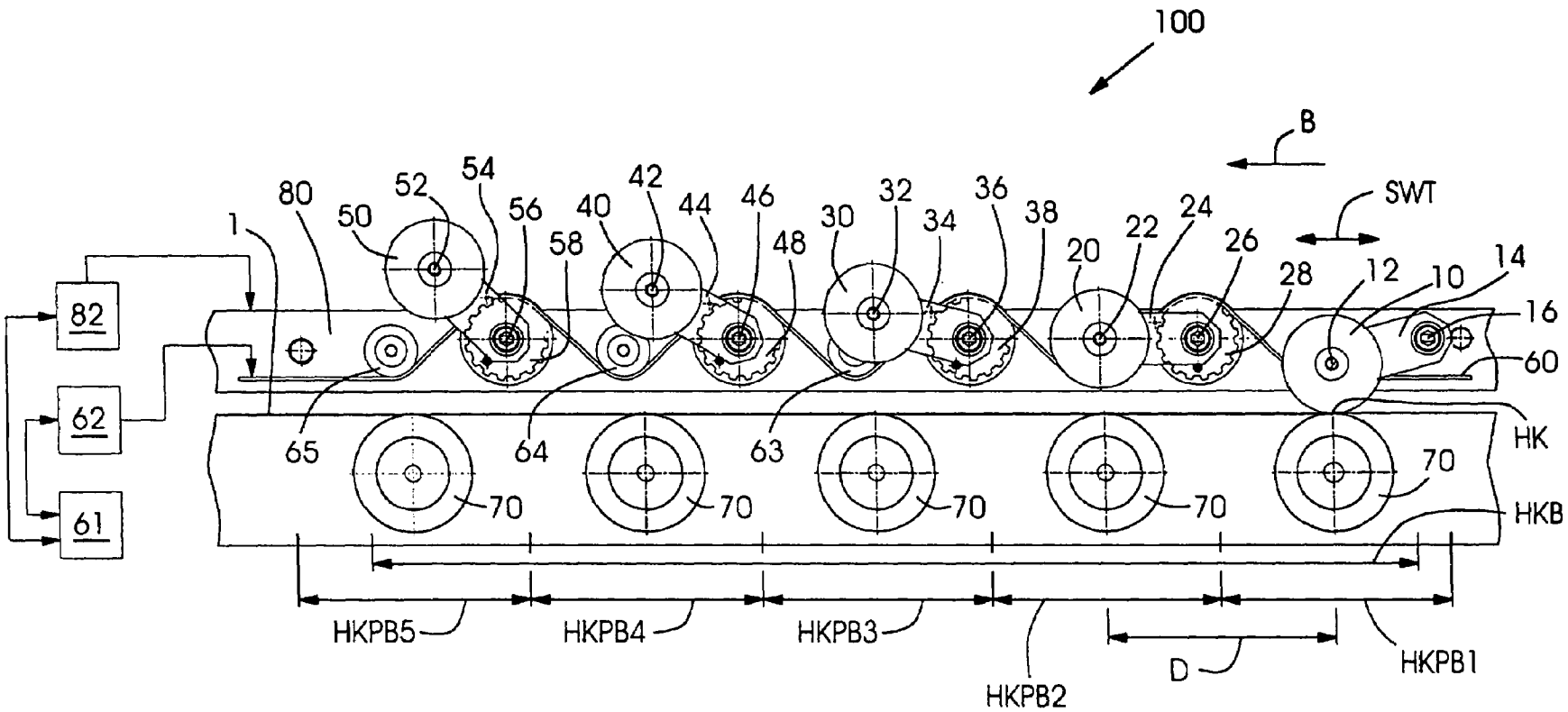
FIG. 1 is a diagrammatic, side-eleveational view of essential parts of an apparatus according to the invention with an active positioning device.

Referring now to the figures of the drawing in detail and first, particularly, to FIG. 1 thereof, there is shown parts of an embodiment of an apparatus 100 according to the invention. In the figures, elements such as drives, cams, housings, controllers and so on known to those skilled in the art are shown only in highly simplified form if they are at the discretion of those skilled in the art.

The embodiment shown of the apparatus 100 according to the invention is part of a combination folding machine and is disposed upstream of a first blade folding unit there. Combination folding machines and blade folding units are known to those skilled in the art in large numbers from the prior art. In such a combination folding machine, the parallel folds are folded in a first folding station on the pocket folding principle, while the subsequent cross folds are carried out with a folding blade operating vertically. To this end, following an outlet from the parallel fold, the folded sheets 1, 2 are transported without slippage to a cross folding station by non-illustrated transport belts. In order to ensure actually slippage-free transport, the transported flat goods must be held down and pressed vertically onto the transport belt.

During alignment of the sheets 1, 2 with leading edge and trailing edge stops in the first blade folding unit, the folded sheet is aligned longitudinally and centrally with respect to the following blade folding unit. In this case, a trailing edge HK of the sheet 1, 2 can come to lie in a trailing edge range HKB, depending on the size of the sheet 1, 2. The trailing edge range HKB is limited on one side by the greatest extent of the sheet 1, 2 in the transport direction, which is identified by arrow bearing the designation B, which the folding machine can still process and is limited on the other side by the smallest extent of the sheet 1, 2 in the transport direction B which can still be processed by the folding machine. An extent L1, L2 of the sheet 1, 2 in the transport direction B in this case depends both on the unfolded dimensions of the sheet 1, 2 and also on possible preceding operations in the pocket folding units. Here, the trailing edge range corresponds exactly to half the difference between the greatest possible length L1 (FIG. 2) of the largest possible sheet 1 and the smallest possible length L2 (FIG. 4) of the smallest possible sheet 2. This is because the folded sheet is folded longitudinally and centrally around a center line ML of the sheet 1, 2, see FIG. 2 and FIG. 4, and the folding blade is not moved for this purpose. Half of the distance is apportioned to a displacement of a leading edge stop 90. Otherwise, the type of adjustment of the leading edge stop 90 by an actuating travel SWA is not essential to the invention.

As can be seen in FIG. 1 to FIG. 4, a plurality of positioning devices 10, 20, 30, 40, 50 are disposed along the transport path B of the sheet. The positioning devices 10, 20, 30, 40, 50 are in particular guide rollers 10, 20, 30, 40, 50. Each of the guide rollers 10, 20, 30, 40, 50 is assigned a back-pressure roller 70. In a particularly advantageous embodiment that is not shown, the guide rollers 10, 20, 30, 40, 50 are assigned a transport belt as a common back-pressure device. A transport belt of this type is advantageously assisted by appropriate back-pressure rollers 70 opposite the guide rollers 10, 20, 30, 40, 50, but it is also conceivable that the transport belt merely runs in a suitable groove.

The guide rollers 10, 20, 30, 40, 50 are fitted to a common carrier 80. The carrier 80 can be displaced along the transport path by an actuating travel SWT by a drive 82. The displacement of the carrier 80 is advantageously carried out automatically in interaction with information with regard to the intended position of the trailing edge HK of the sheet 1, 2. This information is interchanged with a controller 61, with which at least the two drives 62, 82 interact and exchange data with one another. By the actuating travel of the carrier SWT, each individual positioning element 10, 20, 30, 40, 50 can be displaced within a trailing edge positioning range HKPB1, HKPB2, HKPB3, HKPB4, HKPB5. In this case, the length of the actuating travel of the carrier SWT is such that it exceeds the length of each individual trailing edge positioning range HKPB1, HKPB2, HKPB3, HKPB4, HKPB5 somewhat. The individual trailing edge positioning ranges HKPB1, HKPB2, HKPB3, HKPB4, HKPB5 do not overlap but adjoin one another directly. In total, the trailing edge positioning ranges HKPB1, HKPB2, HKPB3, HKPB4, HKPB5 project somewhat beyond the trailing edge range HKB. Partial mutual overlapping of the trailing edge positioning ranges HKPB1, HKPB2, HKPB3, HKPB4, HKPB5 is also conceivable. The length of a trailing edge positioning range HKPB1, HKPB2, HKPB3, HKPB4, HKPB5 corresponds precisely to a distance D between two adjacent guide rollers 10, 20, 30, 40, 50 from one another. However, it is also conceivable to configure the guide rollers 10, 20, 30, 40, 50 not to be equidistant; however the equidistant embodiment of the guide rollers 10, 20, 30, 40, 50 is more practical. The trailing edge range HKB is ultimately subdivided into 5 trailing edge positioning ranges HKPB1, HKPB2, HKPB3, HKPB4, HKPB5 in this exemplary embodiment, and the necessary actuating travel of the carrier STW is reduced to approximately one fifth.

The individual guide rollers 10, 20, 30, 40, 50 can rotate freely in the clockwise direction about a roller axis 12, 22, 32, 42, 52 in the present embodiment. The guide rollers 10, 20, 30, 40, 50 are sprung against the back-pressure rollers 70. To this end, all the guide rollers 10, 20, 30, 40, 50 have a swinging arm 14, 24, 34, 44, 54, by which they can be pivoted about a corresponding pivot axis 16, 26, 36, 46, 56. In this case, the first guide roller 10 in the transport direction is always in an active operating position and therefore interacts continuously with the corresponding back-pressure roller 70. The first guide roller 10 pivots about the pivot axis 16 when it is lifted off the back-pressure roller 70 counter to the spring force by the thickness of an incoming sheet 1, 2.

Figure 2:
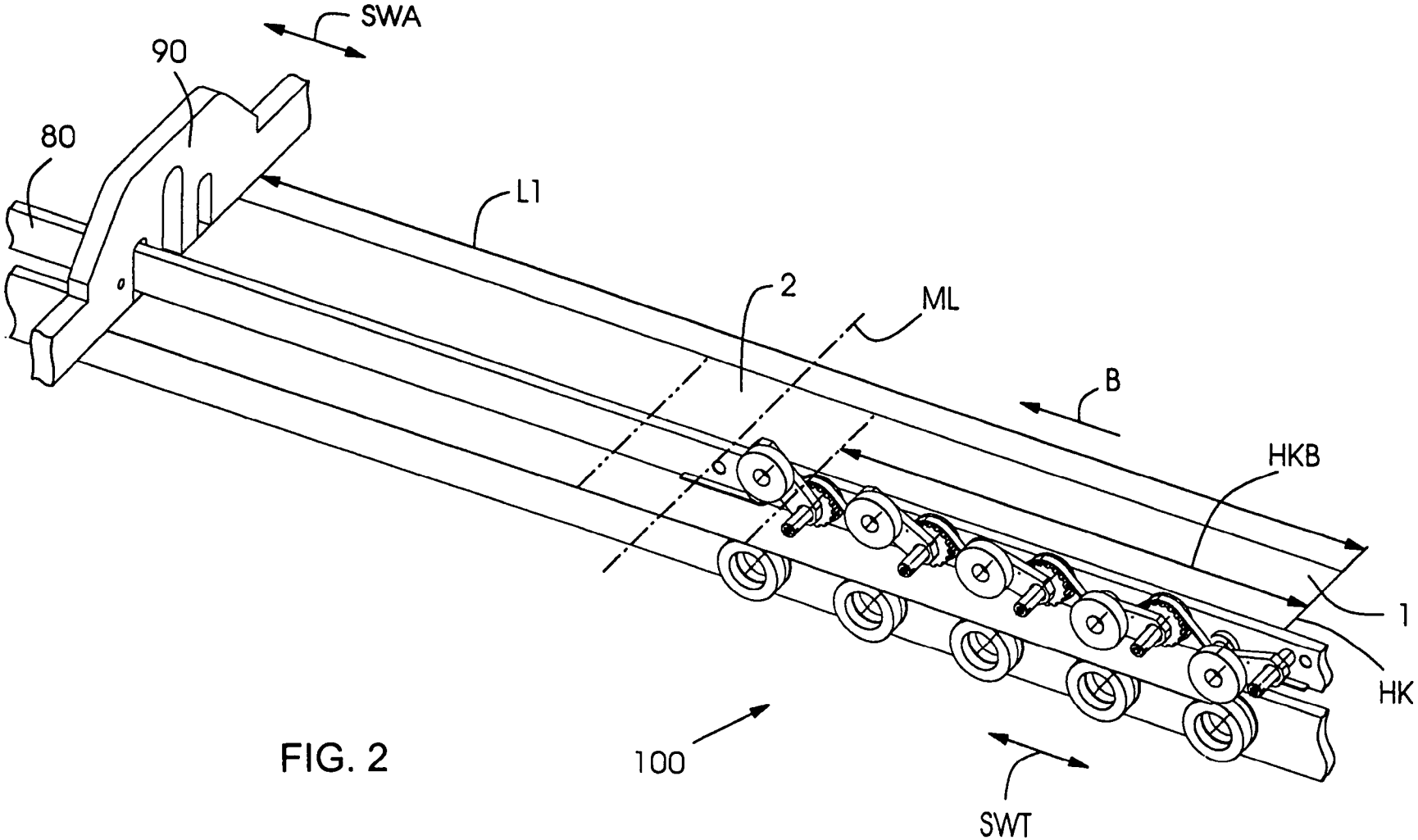
FIG. 2 is a diagrammatic, perspective view of the apparatus with a leading edge stop in the case of the largest possible sheet.
Figure 3:
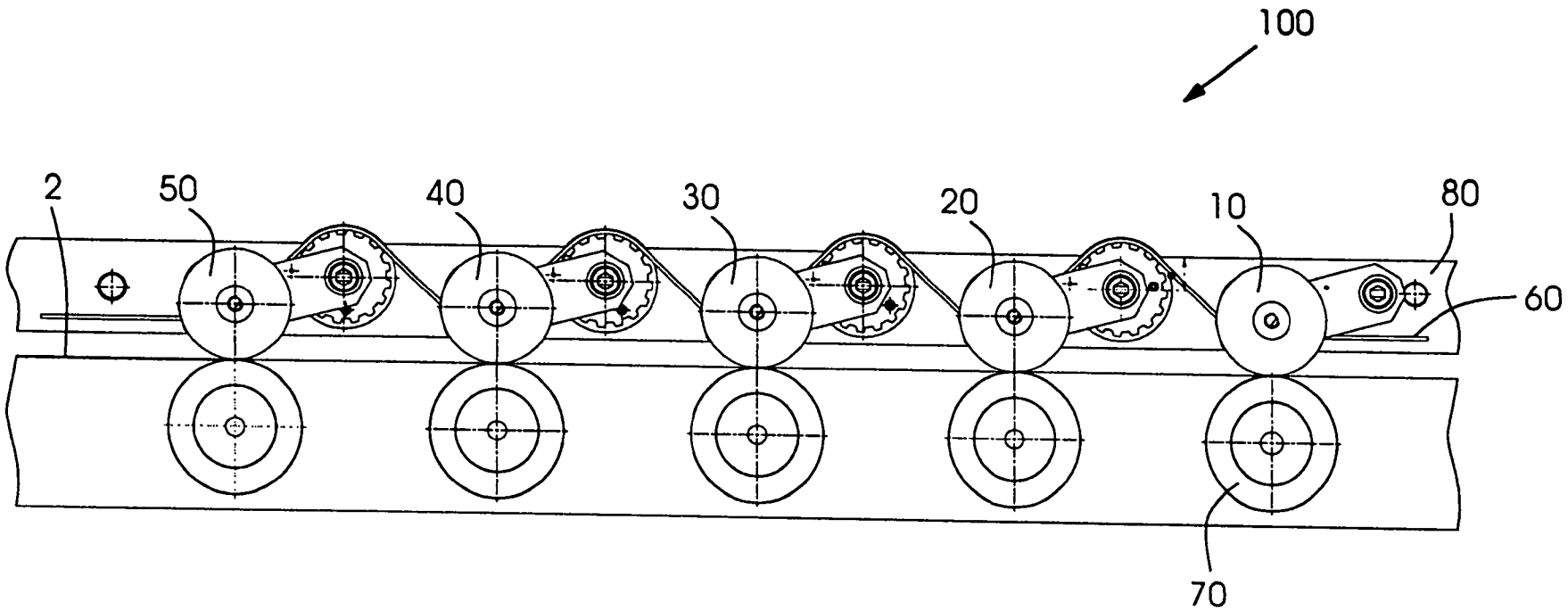
FIG. 3 is a diagrammatic, side-elevational view of the essential parts of the apparatus according to the invention with five active positioning devices.
Figure 4:
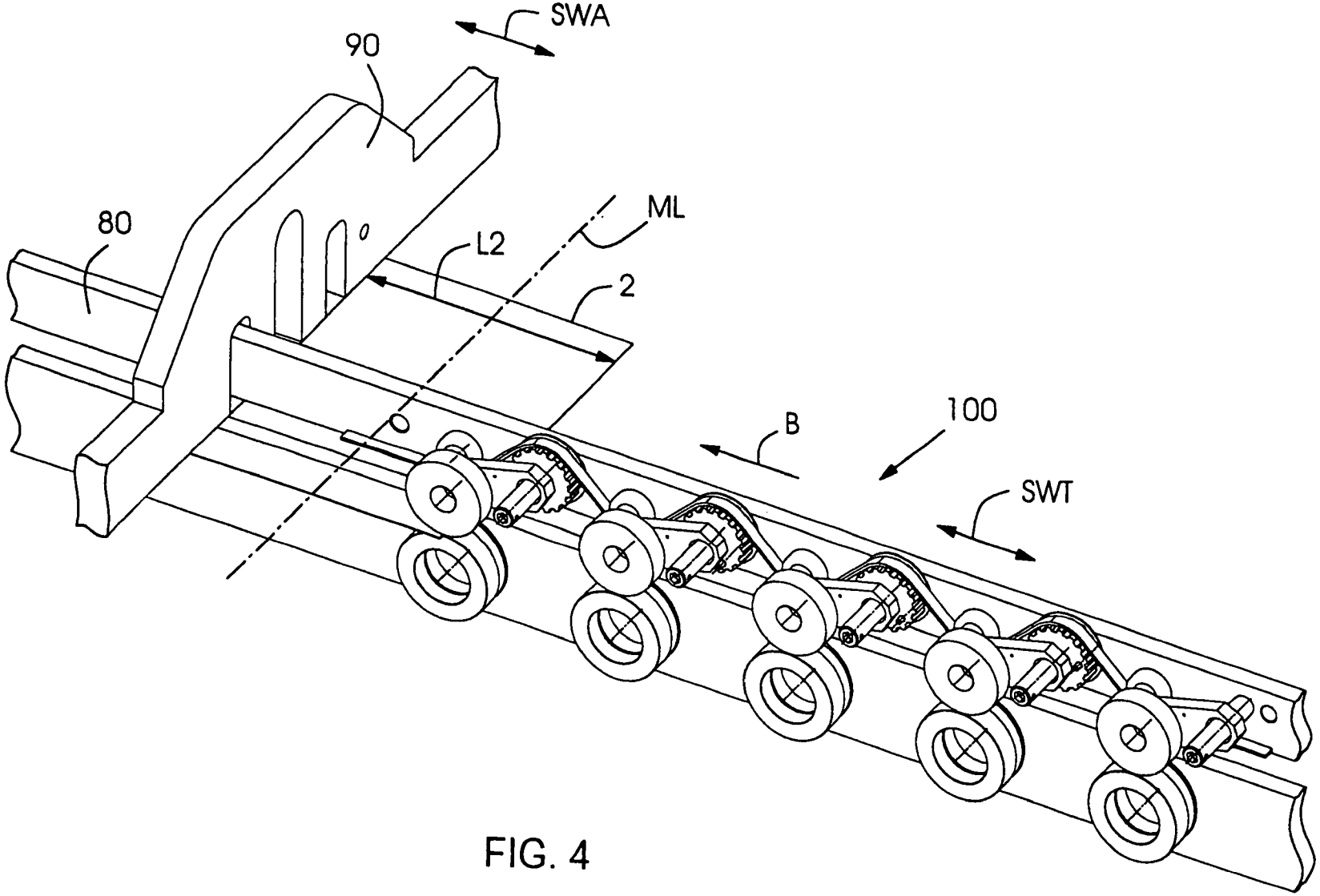
FIG. 4 is a diagrammatic, perspective view of the apparatus with the leading edge stop in the case of the smallest possible sheet.

All the guide rollers 20, 30, 40, 50 following downstream are connected to an activation device 60, a toothed belt 60 which is wrapped around a corresponding gear wheel 28, 38, 48, 58 and is tensioned by tensioning rollers 63, 64, 65 which are disposed between the guide rollers 10, 20, 30, 40, 50. In addition, the activation device contains the drive 62, which effects a movement of the toothed belt 60 and therefore a rotation of the gear wheels 28, 38, 48, 58. The respective gear wheel 28, 38, 48, 58 in each case has a dog 29, 39, 49, 59, which is in contact with the respective swinging arm 24, 34, 44, 54 of the appropriate guide roller 20, 30, 40, 50 when the guide roller is in a passive operating position. In this case, the position of the dog 29, 39, 49, 59 when the toothed belt 60 is incorporated is displaced by a few degrees of angle in the clockwise direction downstream from guide roller 20, 30, 40, 50 to guide roller 20, 30, 40, 50. The result, as shown in FIG. 1 and FIG. 2, is that the guide roller 20, 30, 40, 50 is moved further and further away from the corresponding back-pressure device 70 in the transport direction B. This has the effect that, during the movement of the toothed belt 60 in the transport direction B, first the second transport roller 20, then the third transport roller 30, then the fourth transport roller 40 and lastly also the fifth transport roller 50 is lowered. In the process, the dogs 29, 39, 49 in the preceding guide rollers 20, 30, 40 are moved further and further away from the contact point with the swinging arm 24, 34, 44 as soon as the interaction of the respective guide roller 20, 30, 40 with the associated back-pressure device 70 begins. This state is shown in FIG. 3 and FIG. 4.

An alternative embodiment is illustrated in FIGS. 5 to 8.

The individual guide rollers 10, 20, 30, 40, 50 can rotate freely in the clockwise direction about the roller axis 12, 22, 32, 42, 52 in this embodiment. The guide rollers 10, 20, 30, 40, 50 are likewise sprung against the back-pressure rollers 70. To this end, all the guide rollers 10, 20, 30, 40, 50 have the swinging arm 14, 24, 34, 44, 54, by which they can be pivoted about the corresponding pivot axis 16, 26, 36, 46, 56. In this case, the first guide roller 10 in the transport direction is always in an active operating position and therefore interacts continuously with the corresponding back-pressure roller 70. The first guide roller 10 pivots about the pivot axis 16 when it is lifted off the back-pressure roller 70 counter to the spring force by the thickness of an incoming sheet 1, 2.

The guide rollers 20, 30, 40, 50 following downstream have an adjusting surface 112 at their one end of the swinging arm 24, 34, 44, 54. The adjusting surface 112 interacts with pins 111 which are fixed to an adjustable actuating strip 110. The adjustable actuating strip 110 is connected to the drive 62, which sets the strip moving linearly. The pins 111 are disposed on the strip 110 in such a way that they touch the adjusting surfaces 112 sequentially and therefore bring the rollers 20, 30, 40, 50 sequentially from a passive into an active operating position.

Figure 5:
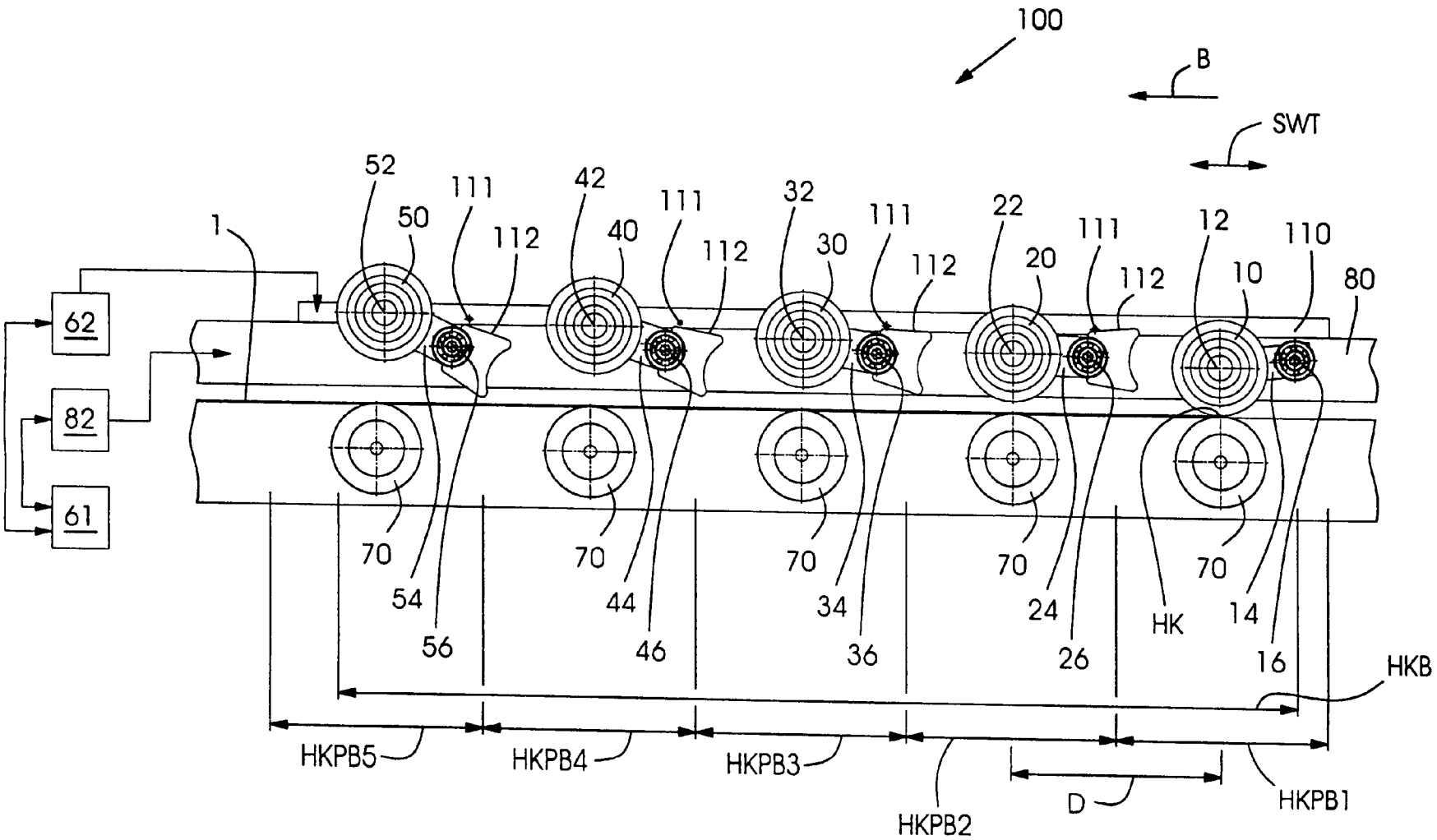
FIG. 5 is a diagrammatic, side-elevational view of the essential parts of a further apparatus according to the invention with an active positioning device.
Figure 6:
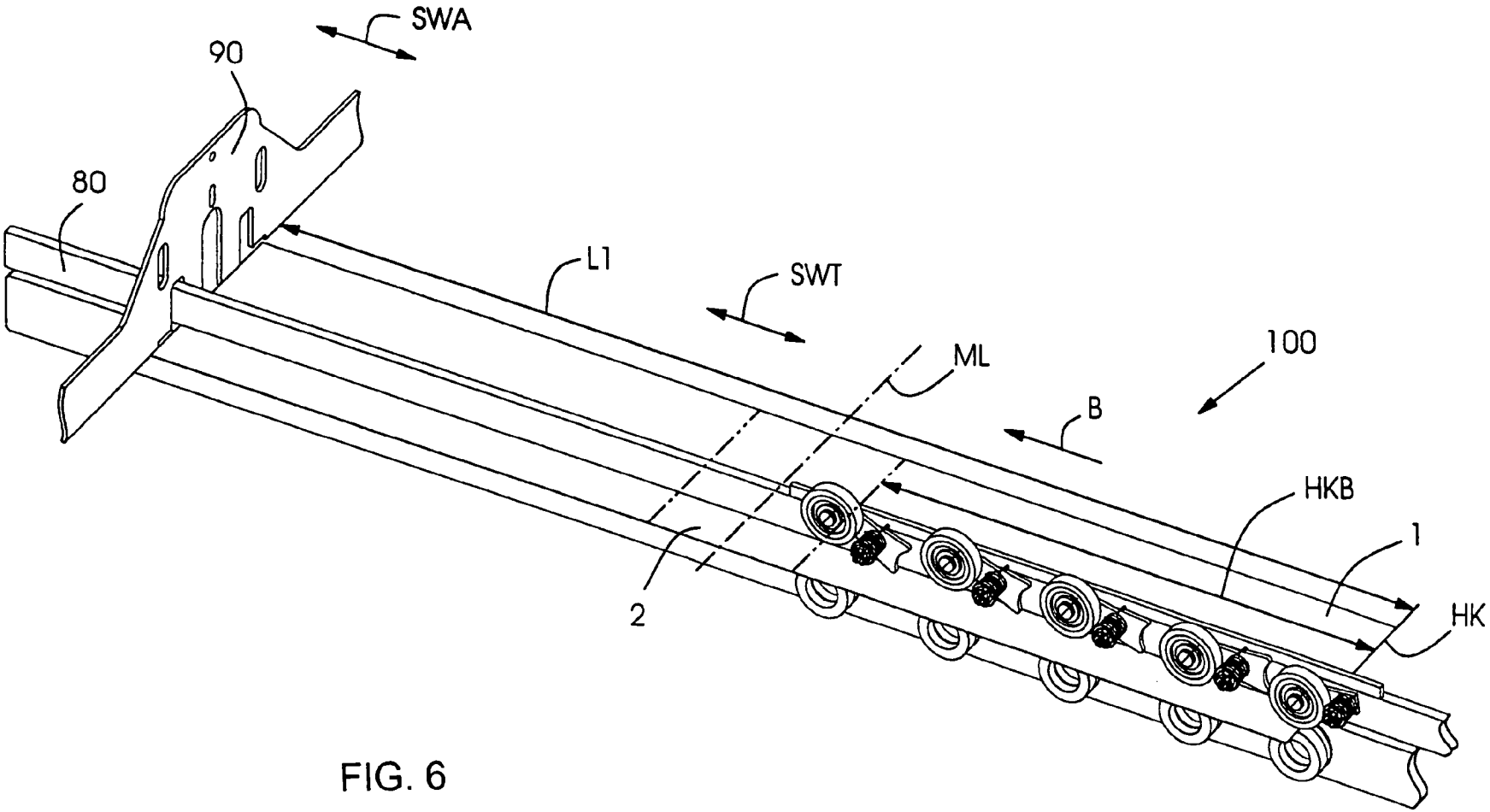
FIG. 6 is a diagrammatic, perspective view of the further apparatus according to the invention with the leading edge stop in the case of the largest possible sheet.
Figure 7:
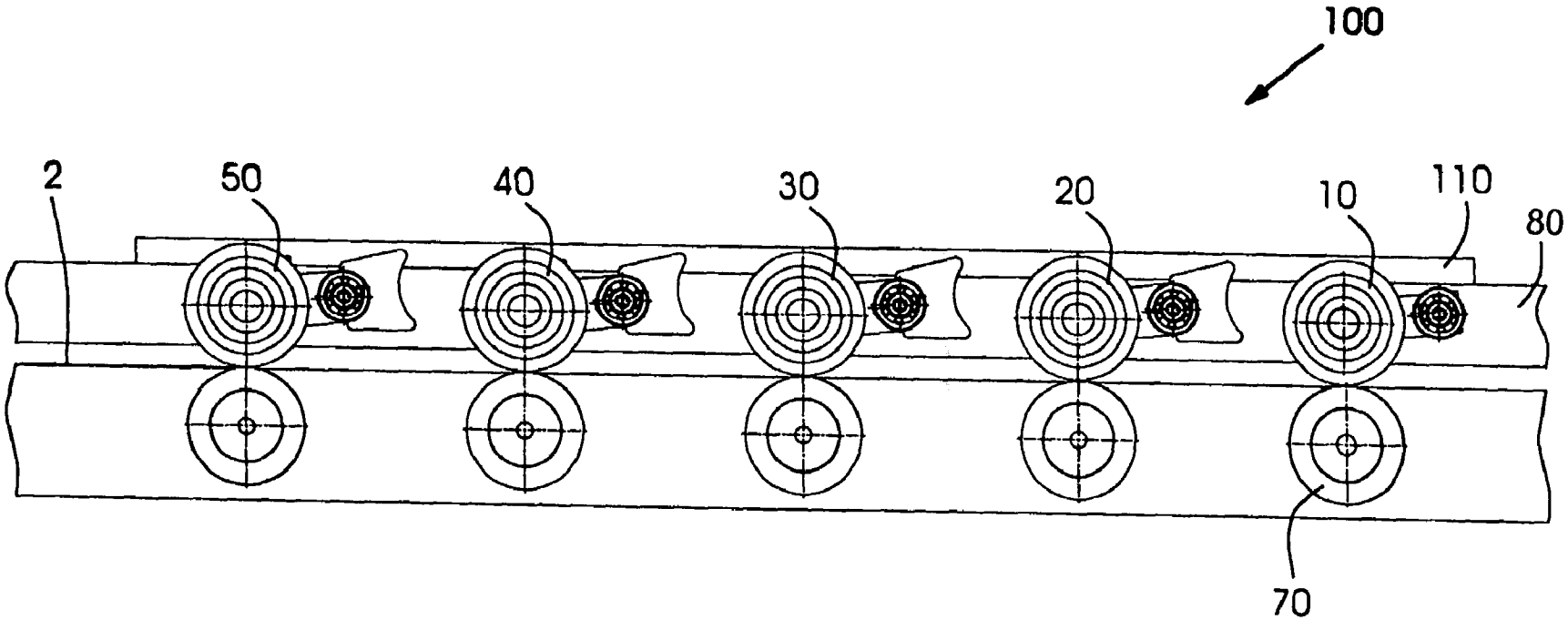
FIG. 7 is a diagrammatic, side-elevational view of the essential parts of the further apparatus according to the invention with five active positioning device.
Figure 8:
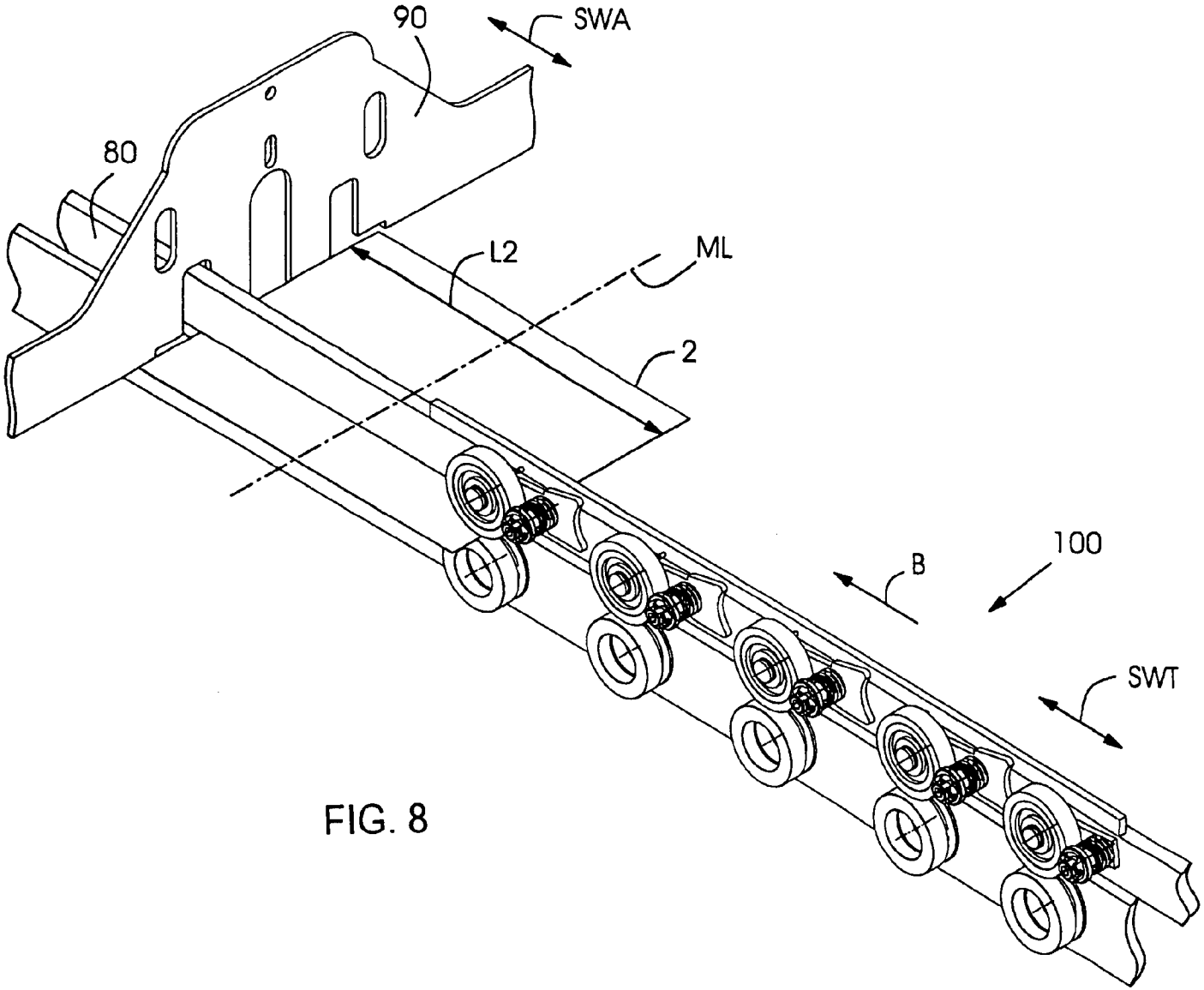
FIG. 8 is a diagrammatic, perspective view of the further apparatus according to the invention with the leading edge stop in the case of the smallest possible sheet.

The result, as FIGS. 5 and 6 show, is that the guide rollers 20, 30, 40, 50 are moved further and further away from the corresponding back-pressure device 70 in the transport direction B. This has the effect that, during the movement of the adjustable actuating strip 110 in the transport direction B, first the transport roller 20, then the third transport roller 30, then the fourth transport roller 40 and finally also the fifth transport roller 50 will then be lowered. In the process, the pins 111 in the preceding guide rollers 20, 30, 40 are moved further and further away from the adjusting surface 112 of the swinging arms 24, 34, 44 as soon as the interaction of the respective guide roller 20, 30, 40 with the associated back-pressure device 70 begins. This state is shown in FIGS. 7 and 8.

Figure 9:
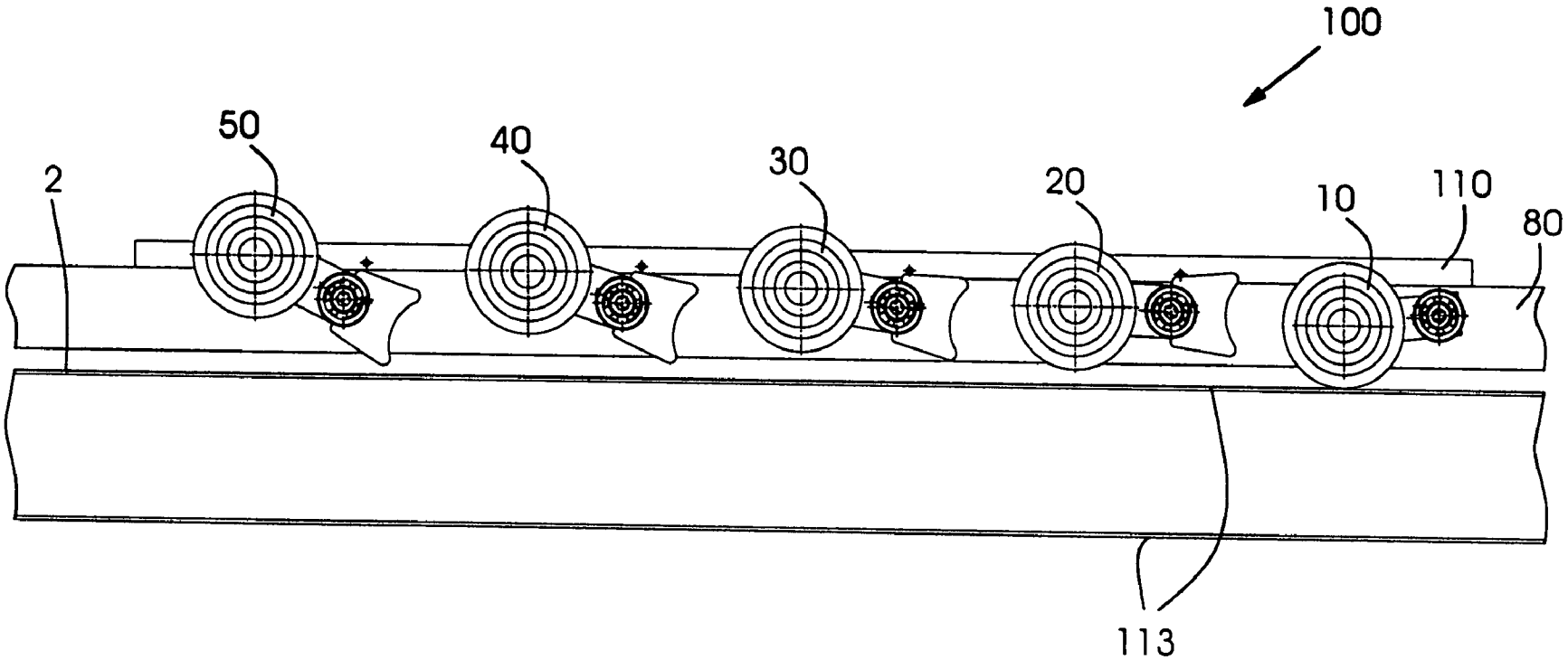
FIG. 9 is a diagrammatic, side-elevational view of the further apparatus according to the invention with a continuous back-pressure belt.

In a further embodiment, the back-pressure rollers 70 are configured as a continuous belt 113, as illustrated in FIG. 9.

Then, if a change between two sheet sizes is carried out, it is first determined in which trailing edge positioning range HKPB1, HKPB2, HKPB3, HKPB4, HKPB5 the trailing edge HK of the sheet 1, 2 falls. Then, the positioning devices 10, 20, 30, 40, 50 assigned to the trailing edge positioning range HKPB1, HKPB2, HKPB3, HKPB4, HKPB5 is moved to the appropriate position within the available actuating travel of the carrier STW, and the leading edge stop 90 is likewise moved into the appropriate position. Then, if for example the trailing edge HK of a sheet 1, 2 falls into the trailing edge positioning region HKPB3 of the guide roller 30, then the third guide roller 30 would be positioned exactly at the location of the trailing edge HK of the sheet 1, 2, the guide rollers 10, 20 located upstream would likewise be in an active operating position, in which they hold down the sheet for as long as possible on the way to the leading edge stop. The guide rollers 40, 50 located downstream would, on the other hand, be in a passive operating position, in which they do not hinder the folding of the sheet 1, 2.

Such an apparatus according to the invention can be used in all blade folding or combination folding machines, in particular including in the second and third cross fold, but also in other apparatus in which the intention is to ensure the longest possible guidance of the products to be processed with, at the same time, a fast format change and high positioning accuracy.

We claim:

1. An apparatus for positioning sheets, comprising:

a trailing edge range, in which a trailing edge of a sheet being positioned in a transport direction, depending on dimensions of the sheet;

a carrier;

a plurality of positioning devices for positioning the trailing edge of the sheet, said positioning devices fixed to said carrier such that respectively different trailing edge positioning ranges of individual ones of said positioning devices in total cover entirely the trailing edge range but each of said respectively different trailing edge positioning ranges is shorter in the transport direction than the trailing edge range; and a carrier actuating device for moving said carrier by a predefined actuating travel in the transport direction of the sheets, so that the trailing edge of the sheet can be positioned within one of said respectively different trailing edge positioning ranges.

2. The apparatus according to claim 1, wherein the respectively different trailing edge positioning ranges of said positioning devices do not overlap each other.

3. The apparatus according to claim 1, wherein the predefined actuating travel of said carrier in the transport direction of said carrier is somewhat longer than a length of individual ones of the respectively different trailing edge positioning ranges of said positioning devices.

4. The apparatus according to claim 1, wherein said positioning devices are guide rollers under an action of spring forces.

5. The apparatus according to claim 4, further comprising a back-pressure device cooperating with said guide rollers.

6. The apparatus according to claim 5, wherein said back-pressure device is selected from the group consisting of a common belt and a plurality of individual backing rollers.

7. The apparatus according to claim 1, further comprising an activation device associated with said positioning devices, said activation device moving said positioning devices into an operating position selected from the group consisting of an active operating position and a passive operating position.

8. The apparatus according to claim 7, wherein said activation device is a common pulling device adjusting the operating position of all of said positioning devices.

9. The apparatus according to claim 7, wherein said activation device is configured such that, following a movement of one of said positioning devices disposed after a first one of said positioning devices in the transport direction into the active operating position, all of said positioning devices disposed upstream are in the active operating position.

10. The apparatus according to claim 7, wherein said activation device is configured such that, following a movement of one of said positioning devices disposed after a first one of said positioning devices in the transport direction into the passive operating position, all of said positioning devices disposed downstream are in the passive operating position.

11. The apparatus according to claim 8, wherein said common pulling device is a toothed belt.

12. The apparatus according to claim 8, wherein said common pulling device is an adjustable actuating strip.

13. In combination with a combination folding machine, an apparatus for positioning sheets moving in the combination folding machine, the apparatus comprising:

a trailing edge range, in which a trailing edge of a sheet being positioned in a transport direction, depending on dimensions of the sheet;

a carrier;

a plurality of positioning devices for positioning the trailing edge of the sheet, said positioning devices fixed to said carrier such that respectively different trailing edge positioning ranges of individual ones of said positioning devices in total cover entirely the trailing edge range but each of said respectively different trailing edge positioning ranges is shorter in the transport direction than the trailing edge range; and a carrier actuating device for moving said carrier by a predefined actuating travel in the transport direction of the sheets, so that the trailing edge of the sheet can be positioned within one of said respectively different trailing edge positioning ranges.

14. The apparatus according to claim 1, further comprising:

a controller configured for controlling said carrier actuating device to move said carrier.

15. The apparatus according to claim 13, further comprising:

a controller configured for controlling said carrier actuating device to move said carrier.

* * * * *